US008000449B2

(12) United States Patent
Hauttmann et al.

(10) Patent No.: US 8,000,449 B2
(45) Date of Patent: Aug. 16, 2011

(54) EMITTER FOR X-RAY TUBES AND HEATING METHOD THEREFORE

(75) Inventors: Stefan Hauttmann, Buchholz (DE); Wolfram Maring, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 180 days.

(21) Appl. No.: 12/445,751

(22) PCT Filed: Oct. 10, 2007

(86) PCT No.: PCT/IB2007/054124

§ 371 (c)(1),
(2), (4) Date: Apr. 16, 2009

(87) PCT Pub. No.: WO2008/047269

PCT Pub. Date: Apr. 24, 2008

(65) Prior Publication Data

US 2010/0316192 A1 Dec. 16, 2010

(30) Foreign Application Priority Data

Oct. 17, 2006 (EP) ..... 06122431

(51) Int. Cl.
*H01J 35/06* (2006.01)
*H01J 1/20* (2006.01)
*H01J 19/14* (2006.01)

(52) U.S. Cl. ..... 378/136; 313/310; 313/337; 313/338; 313/341

(58) Field of Classification Search ..... 378/136; 313/310, 337, 338, 341, 343, 344, 345
See application file for complete search history.

(56) References Cited

U.S. PATENT DOCUMENTS

| | | | | |
|---|---|---|---|---|
| 5,044,005 | A * | 8/1991 | De Fraguier et al. | 378/136 |
| 5,426,686 | A * | 6/1995 | Rentzepis et al. | 378/34 |
| 5,742,662 | A * | 4/1998 | Kuhn et al. | 378/138 |
| 5,907,595 | A * | 5/1999 | Sommerer | 378/136 |
| 6,426,587 | B1 | 7/2002 | Hell et al. | |
| 6,456,691 | B2 * | 9/2002 | Takahashi et al. | 378/122 |
| 6,480,568 | B1 * | 11/2002 | Dinsmore | 378/65 |
| 6,516,048 | B2 * | 2/2003 | Mori | 378/119 |
| 6,785,359 | B2 * | 8/2004 | Lemaitre | 378/136 |
| 2003/0025429 | A1 | 2/2003 | Hell et al. | |
| 2004/0222199 | A1 | 11/2004 | Haga | |

FOREIGN PATENT DOCUMENTS

| | | | |
|---|---|---|---|
| DE | 336781 | A1 | 5/1921 |
| DE | 19911081 | A1 | 9/2000 |
| DE | 10012203 | C1 | 7/2001 |
| DE | 10020266 | A1 | 11/2001 |
| WO | 9639709 | A1 | 12/1996 |

OTHER PUBLICATIONS

Herniter et al: "Temperature-Limited Electron Bombardment Heating Method"; IEEE Transactions on Plasma Science, vol. 19, Issue 6, Dec. 1991, pp. 1279-1289.

* cited by examiner

*Primary Examiner* — Allen C. Ho

(57) ABSTRACT

It is described an emitter (26, 40) for X-ray tubes comprising: a flat foil with an emitting section (30, 46); and at least two electrically conductive fixing sections (31-34; 41-44); wherein the emitting section (30, 46) is unstructured.

12 Claims, 10 Drawing Sheets

EMITTER FOR X-RAY TUBES AND HEATING METHOD THEREFORE

FIELD OF THE INVENTION

The present invention relates to the field of fast high-current electron sources for X-ray tubes. In particular, the present invention relates to an emitter for X-ray tubes, further, a heating device for the emitter, a setup consisting of the emitter and the heating device and a heating method to heat the emitter.

ART BACKGROUND

The future demands for high-end CT and CV imaging regarding the X-ray source are higher power/tube current, shorter response-times regarding the tube current (pulse modulation) and smaller focal spots (FS) for higher image quality.

One key to reach higher power in smaller FS is given by using a sophisticated electron optical concept. But of same importance are the electron source itself and the starting condition of the electrons.

For today's high-end tubes directly heated thin flat emitters are used that are structured to define an electrical path and to obtain the required high electrical resistance. Basically, two different emitter designs comprising the explained features are well known: An emitter with a round or rectangular emitting surface/emitting section.

The first of the two types, for example explained in U.S. Pat. No. 6,426,587 B, is a thermionic emitter with balancing thermal conduction legs. The second type is explained later on. Both types have in common that they are directly heated thin flat emitters and that both emitter designs use slits to create an electric current path.

Generally, these types of emitters have a small thermal response time due to their small thickness of a few hundred of micrometers and sufficient optical qualities owing to their flatness. Variations of such designs are implemented in today's state-of-the-art X-ray tubes.

For directly heated electron sources it is essential that electrical resistance of the emitter and supplied current fulfill a required relation to release the necessary power within the filament following the equation for the power $$P=I\cdot R^2 \quad (1)$$

To achieve high power it is possible to apply high current or to increase the electrical resistance of the emitter. The last way may be realized with the known emitter of U.S. Pat. No. 6,426,587 B1.

The advantage of the emitters of the aforesaid types is that the entire electrical path can be realized with thin wires and narrow slits, resulting in a small device which is optimal for medical X-ray tubes. The disadvantage however may also based on the structuring: The electrical field may penetrates into the slit and the potential lines therefore bend into the slit region. If an electron is emitted from the surface perpendicular to the optical axis but within the region of deformed potential, its tangential velocity component may increases which causes stronger optical aberration of the source resulting in enlarged focal spots. An improvement of these known electron sources is essential.

Therefore, it is an object of the invention to provide an emitter which enables to get still smaller focal spot sizes while using today's sophisticated electron-optical lens systems.

SUMMARY OF THE INVENTION

This object is achieved in accordance with the invention in an emitter for X-ray tubes comprising a flat foil with an emitting section and at least two electrically conductive fixing sections wherein the emitting section is unstructured.

As hereby defined, the term 'unstructured' means that the emitting section has no slits and shows therefore a solid and plain surface. Due to the unstructured emitting section the electrical field is less disturbed as in slit structured emitting sections as known from the art. Surprisingly, eliminating the slit structure reduces the achievable spot size significantly. The emitter leads to smaller focal spot sizes than achievable with common electron sources without losing the necessary fast response times for medical examinations.

In a preferred embodiment of the invention, the foil has a uniformly thickness in a range between 50 μm and 300 μm, preferably, in a range between 100 μm and 200 μm.

According to another preferred variant of the invention, the foil consists of tungsten or a tungsten alloy.

Further, in another embodiment of the invention, the emitting section has a rectangular shape, particularly, a quadratically shape.

According to another preferred embodiment of the invention, the fixing sections have a spring structure. Due to the fact that one major problem of an unstructured flat emitter is the thermal expansion, the spring structure of the fixing sections may compensate this expansion. This compensation could lead to a significantly reduced deformation of the emitting area and thus to a further increased optical quality of the emitter.

According to an exemplary embodiment of the present invention, each fixing section is connected with a corner of the emitting section. This arrangement of the fixing sections allows to apply a mechanical pretension in a way, that the elongation of the emitting area during its hot phase is compensated. The spring structure of each fixing section must be designed following the boundary condition that this pretension causes no plastic deformation. Furthermore, this structure may forms a heat barrier between further terminals located at both ends of the emitter (heat sink) and a hot part of the emitter which leads to the necessary well-defined emitting area.

Furthermore, according to another exemplary embodiment of the present invention, the direction of the resilience of each fixing section is in-line with one diagonal of the shape of the emitting section to compensate the thermal expansion of the emitting section in all plane directions. This leads to a still better compensation of the elongation of the emitting section/emitting area.

The present invention also relates to a heating device to heat the emitter, comprising a flat structured heating section and at least two fixing sections. The heating section is preferably subdivided by a plurality of slits into a plurality of thermal regions. By implementing the heating device with an inhomogeneous temperature distribution, a cold center and an increasing temperature to the edges, in combination with a direct heating of the fixing sections of the emitter leads to an homogeneous temperature and hence electron emitting distribution.

According to another exemplary embodiment of the present invention, the slits have a spiral shape.

According to another exemplary embodiment, the present invention includes a setup comprising the emitter and a heating device.

Another object of the invention is a heating method of the aforesaid setup. The method preferably comprises an electron bombardment onto the emitting section of the emitter and to apply an electrical current $I_H$ onto at least two fixing sections of the heating device. Additionally the method comprises to apply an electrical current into the at least two fixing sections of the emitter.

If it is essential that the response time of the emitting current is short, only little heat capacity should exist or a fast cooling concept must be used. For known directly heated filaments high electrical current is preferred and therefore thick current supply lines and contacts as well as a large cooling system may used. This is not practicable within an X-ray tube for medical applications due to its small size for manual movements or gantry application. The only way to achieve that would be to decrease the thin flat emitter thickness to a few μm which is not practicable owing to the reduced emitter stability during high CT-gantry rotations and accelerations. Therefore the aforesaid heating method may preclude the disadvantages of known methods.

A practicable indirect heating method may be given by a heat flux generation by accelerating electrons that are emitted from a directly heated emitter behind the indirectly heated nonstructured emitter (IHFE). This method is described in IEEE Transactions on Plasma Science, Vol. 19, No. 6, December 1991 and in the patent US 2004/0222199 A1. But these applications suffer from their large sizes and heat capacities with heating-up times of t=10 s or longer which is much to slow for medical applications. By reducing the size may the mechanical stability with respect to the flatness of the emitting surface and the temperature homogeneity get lost. These arising mechanical and thermal problems may be solved by the method of the invention.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered to be disclosed with this application.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

These and other aspects of the present invention will become apparent from and elucidated with reference to the embodiments described hereinafter.

BRIEF DESCRIPTION OF THE INVENTION

Exemplary embodiments of the present invention will be described in the following, with reference to the following drawings.

FIG. 1 *a*) shows a common directly heated first emitter with a rectangular emitting surface.

FIG. 1 *b*) shows a common second emitter with a round emitting surface.

FIG. 9 shows a temperature distribution of the emitter surface shown in

Figure 5:
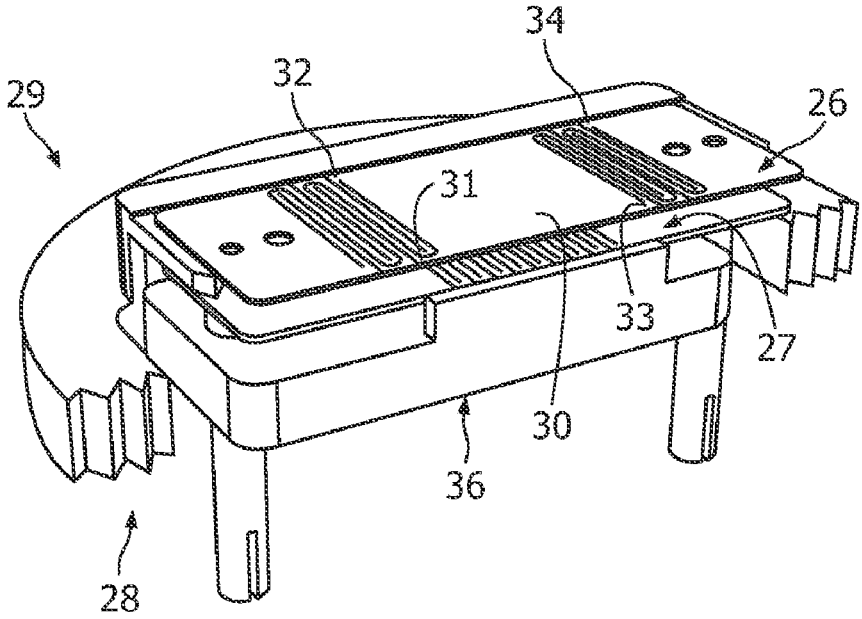
FIG. 5 shows a schematic setup of the indirectly heated emitter according to the invention with a heating device and a part of a cathode cup.
Figure 6:
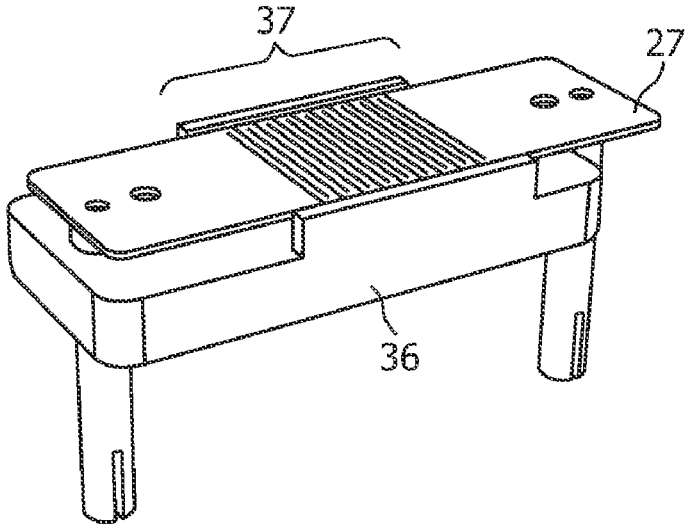
FIG. 6 shows the assembly of FIG. 5 without the emitter and the cathode cup.
Figure 8:
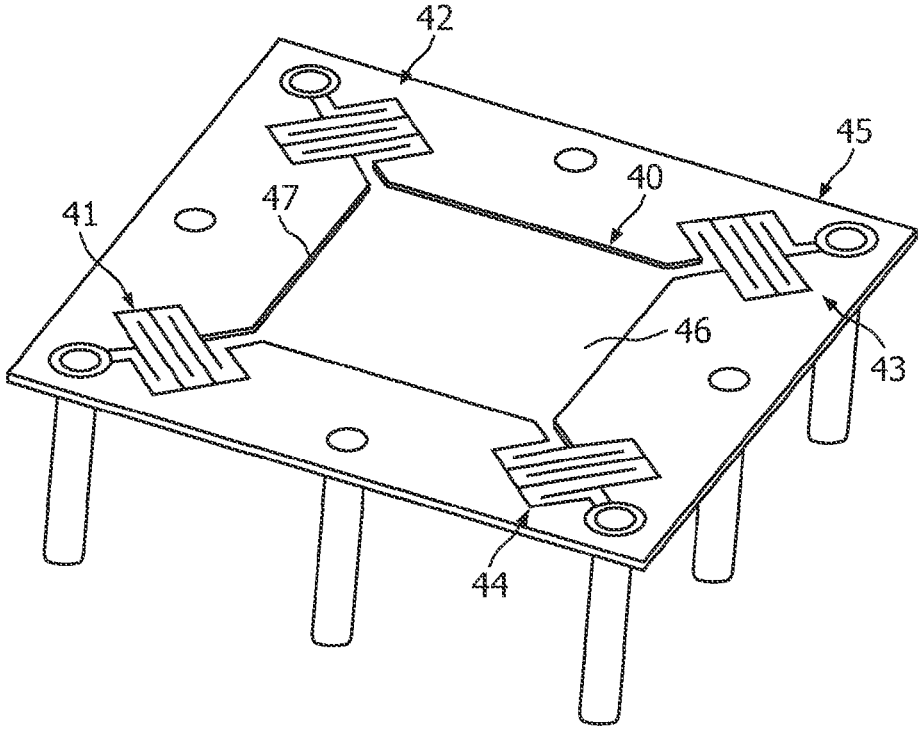
FIG. 8 shows another emitter according to the invention with four fixing sections on a mounting device.

FIG. 8, heated by a heating device like shown in FIG. 5 and FIG. 6.

Figure 10:
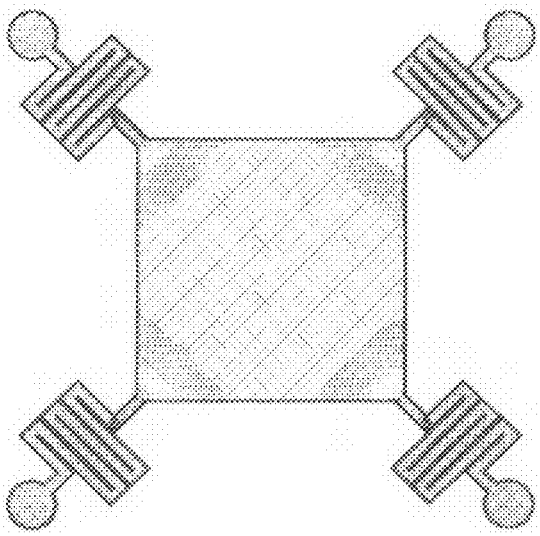

FIG. 10 shows a temperature distribution of the emitter surface more detailed.

Figure 11:
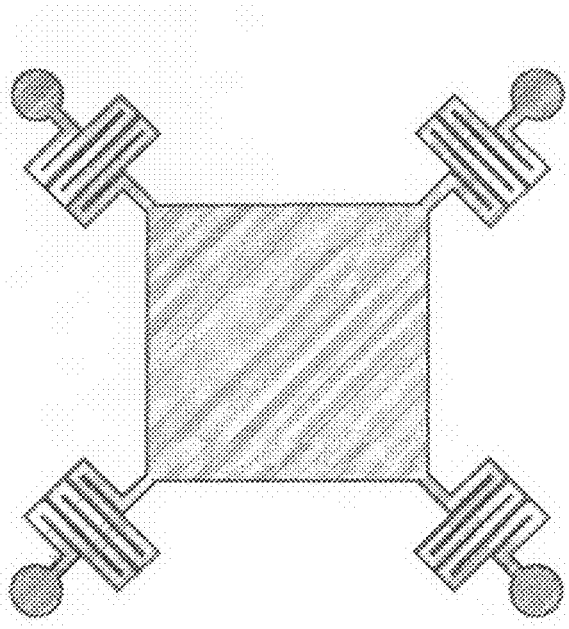

FIG. 11 shows a temperature distribution of the emitter surface with a combination of indirect heating via electron bombardment and direct heating by applying an electrical current to the fixing sections at the corners of the emitting section.

Figure 12:
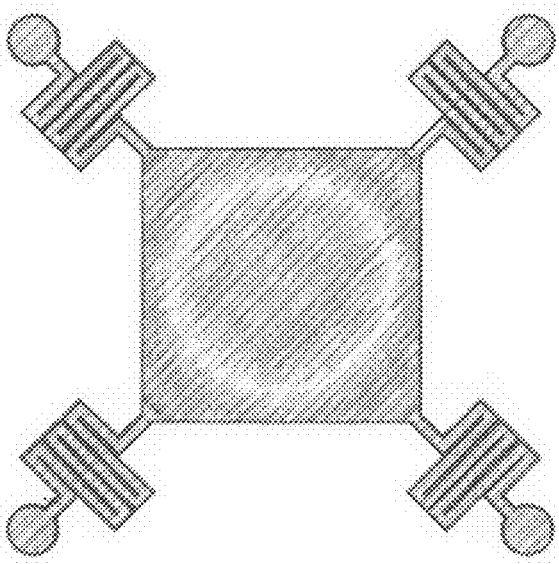

FIG. 12 shows another temperature distribution as shown in FIG. 11.

Figure 13:
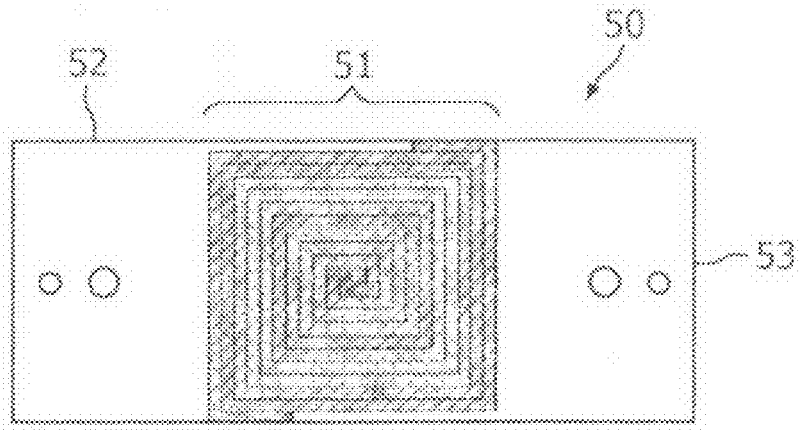

FIG. 13 shows a temperature and electron emitting distribution of a directly heated heating device.

Figure 14:
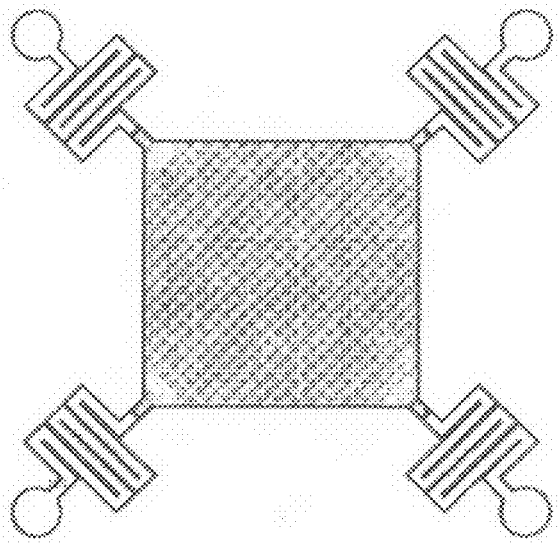

FIG. 14 shows a temperature distribution resulting from the heating device shown in FIG. 13.

Figure 15:
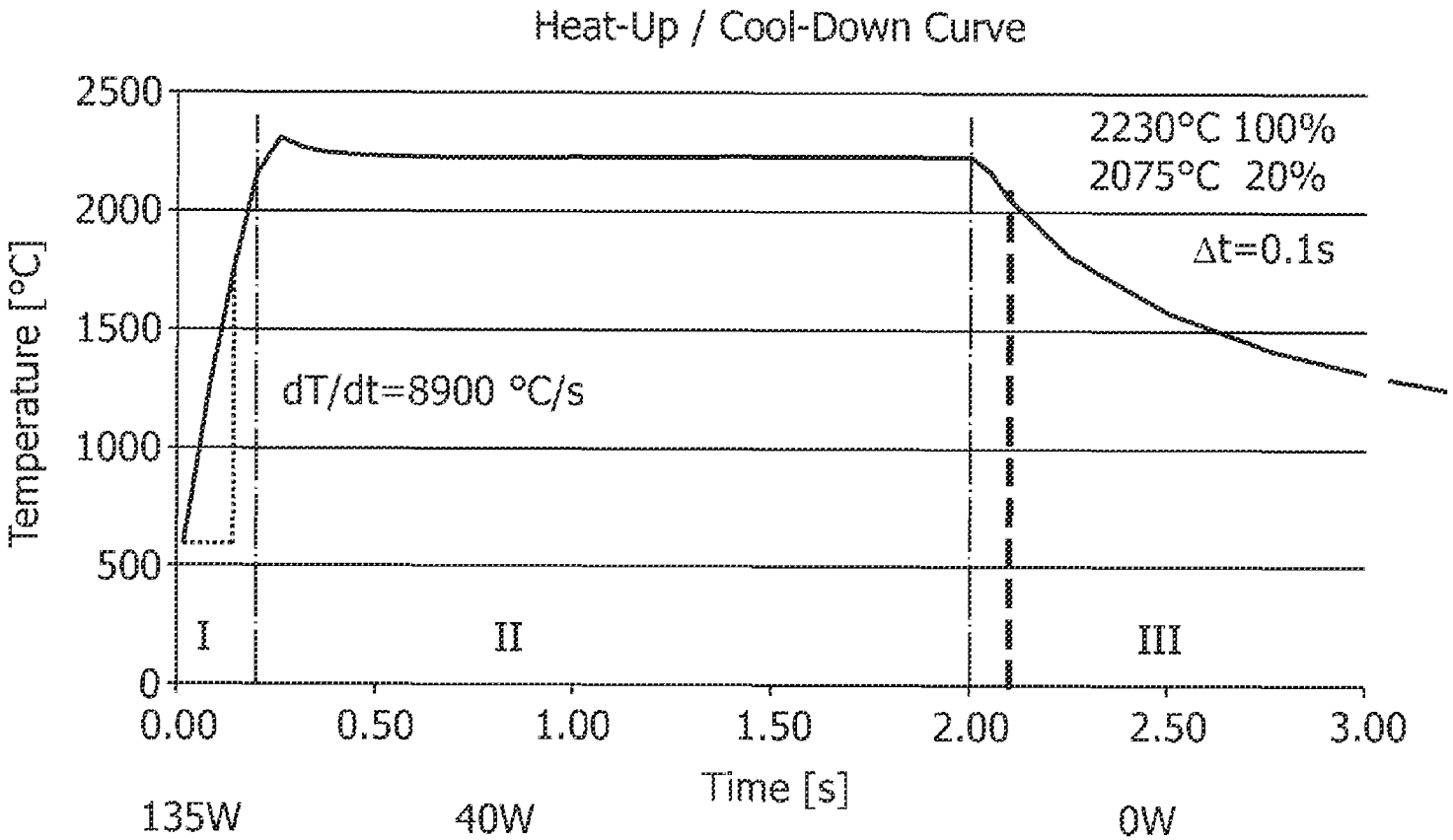

FIG. 15 shows a graph of a transient thermal dynamic of an emitter, whose temperature distribution is shown in FIG. 11

Figure 16:
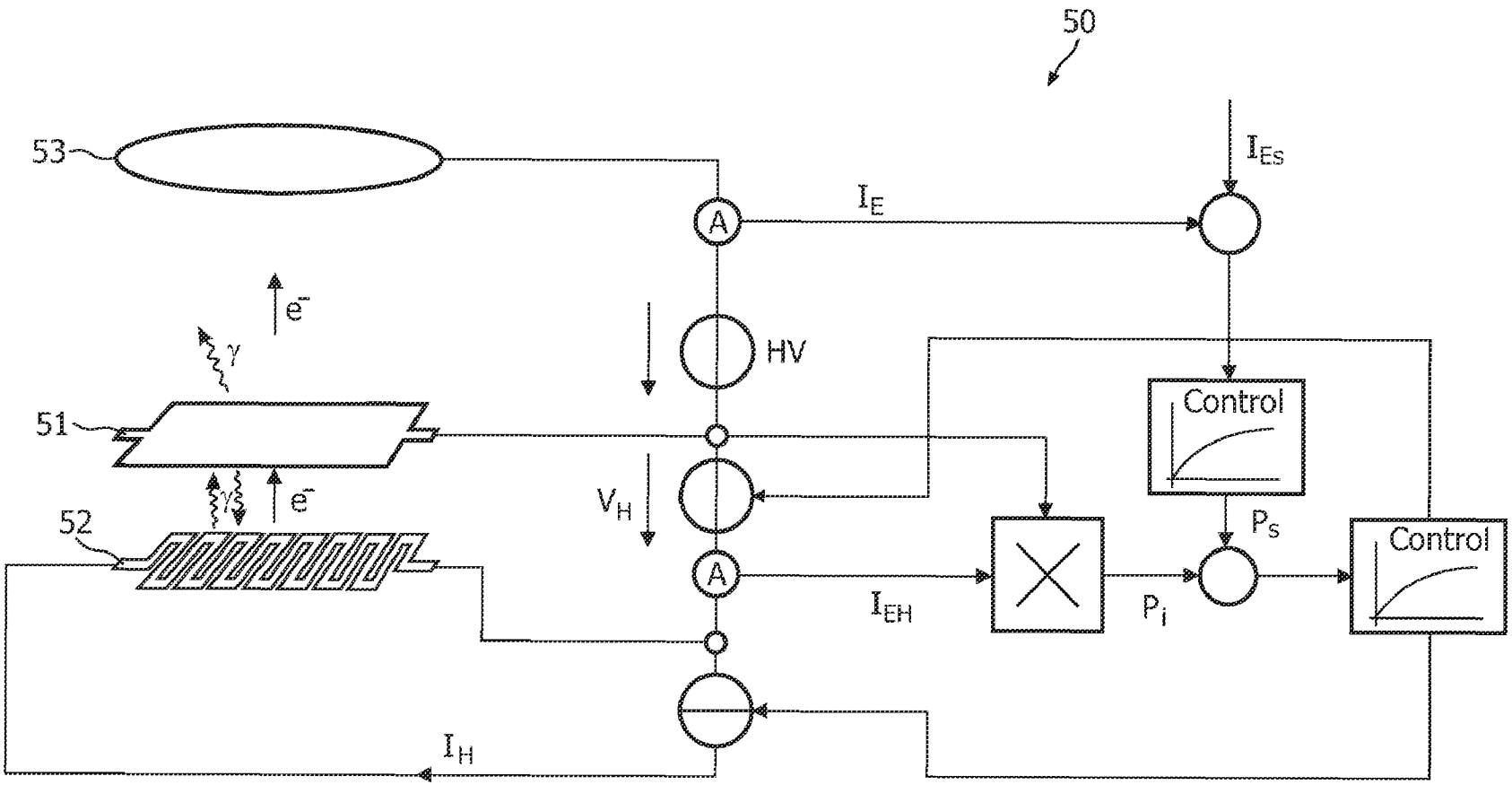

FIG. 16 shows a schematic emitting control setup with an indirectly heated emitter according to the invention.

DETAILED DESCRIPTION

Figure 1A:
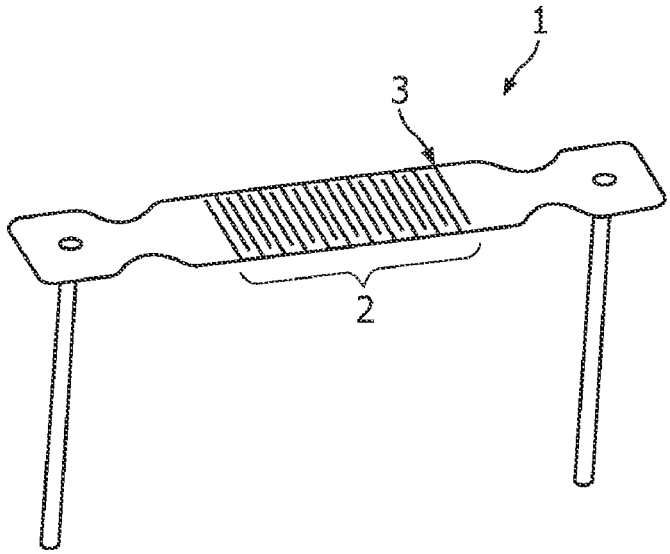

A directly heated thin flat emitter 1 with a rectangular emitting surface 2, as known from the art, is shown in FIG. 1*a*). To create an electric current path the emitter design uses slits 3.

Figure 1B:
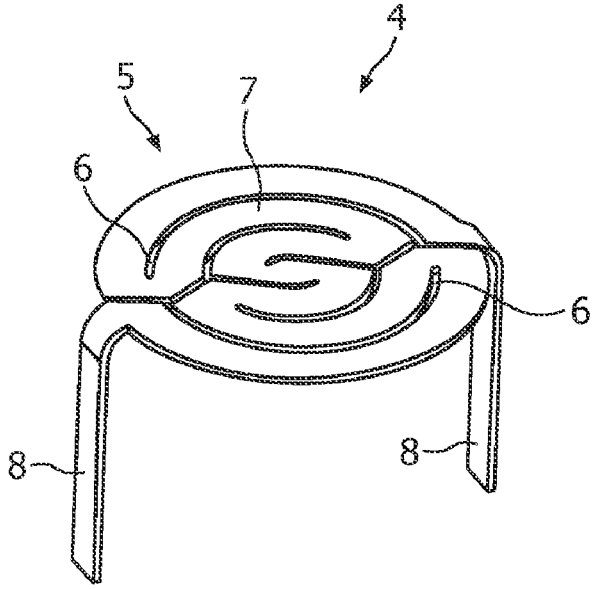

Even the emitter 4 of FIG. 1*b*) with a round emitting surface 5 uses slits 6 and is directly heated. The flat emitting surface 5 is subdivided by the slits into spiral conductor sections 7. Further, FIG. 1*b*) shows formed legs 8, as FIG. 1*a*), which here are angled 90° for installation and simultaneously serve as support elements via a heating current and the cathode high voltage are applied.

Figure 2:
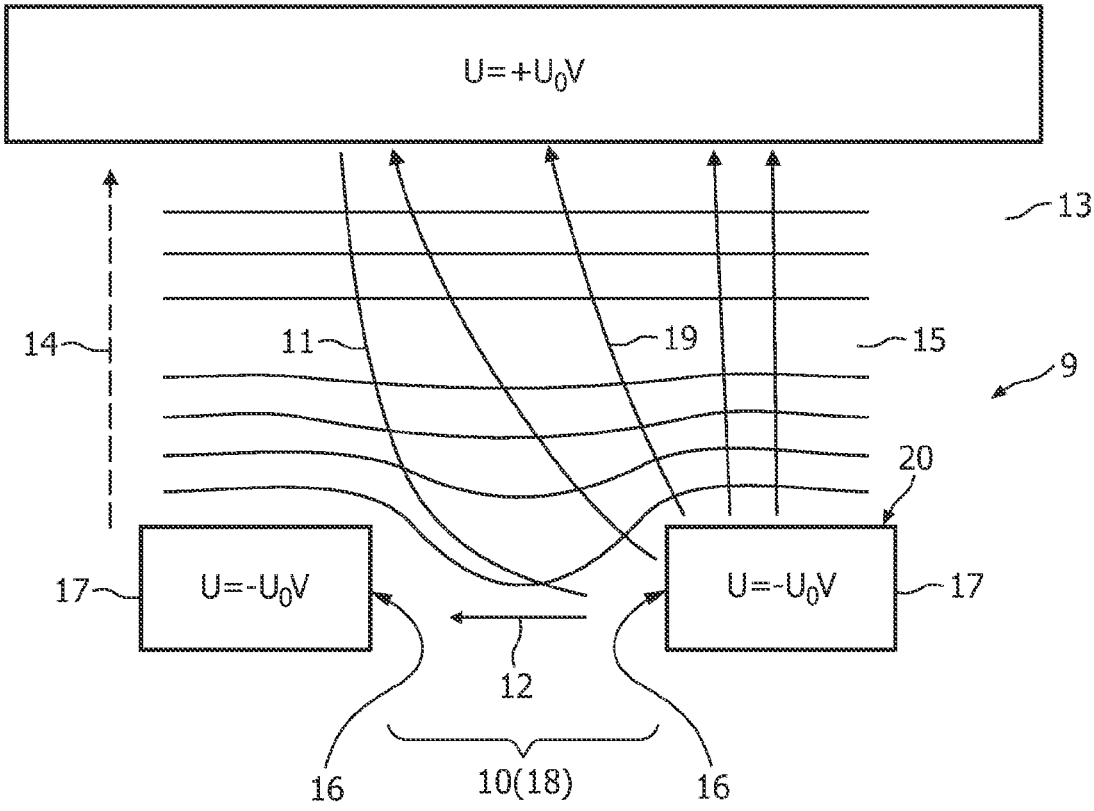
FIG. 2 shows a cross-section of a slit within the emitter with its electrical field and a part of the anode.

FIG. 2 shows an example of a structured directly heated flat emitter (DHFE) of the state of the art. Especially, the influence of a slit structure 10 of an emitter 9, as e.g. shown in FIG. 1*a*) and FIG. 1*b*) to the tracks of the electrons (arrows 11) from negative to positive potential are shown in FIG. 2: The electrons get higher tangential energy components (arrow 12) in relation to an optical axis 14 of the shown setup 13 due to the deformed electrical potential (shown as lines 15) and the emitting surfaces 16 that are not perpendicular to the optical axis 14. In other words, in FIG. 2 it is schematically illustrated how a slit 18 between wires 17 influence the electrical field and the tracks of the emitted electrons. The electrical field penetrates into the slit 18 and the potential lines 15 therefore bend into the slit region 10. If an electron (path 19) is emitted from the surface 20 which is perpendicular to the optical axes 14 but within the region of deformed potential, its tangential velocity component increases. This causes stronger optical aberration of the source resulting in enlarged focal spots.

Figure 4:
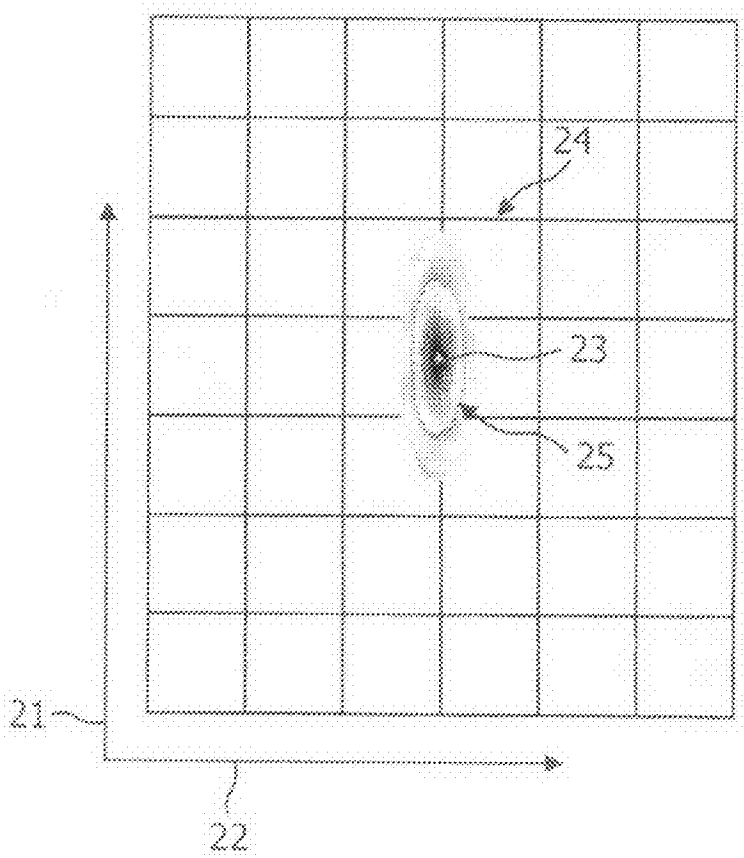
FIG. 4 shows a focal spot example for an unstructured indirectly heated flat emitter (IHFE).
Figure 3:
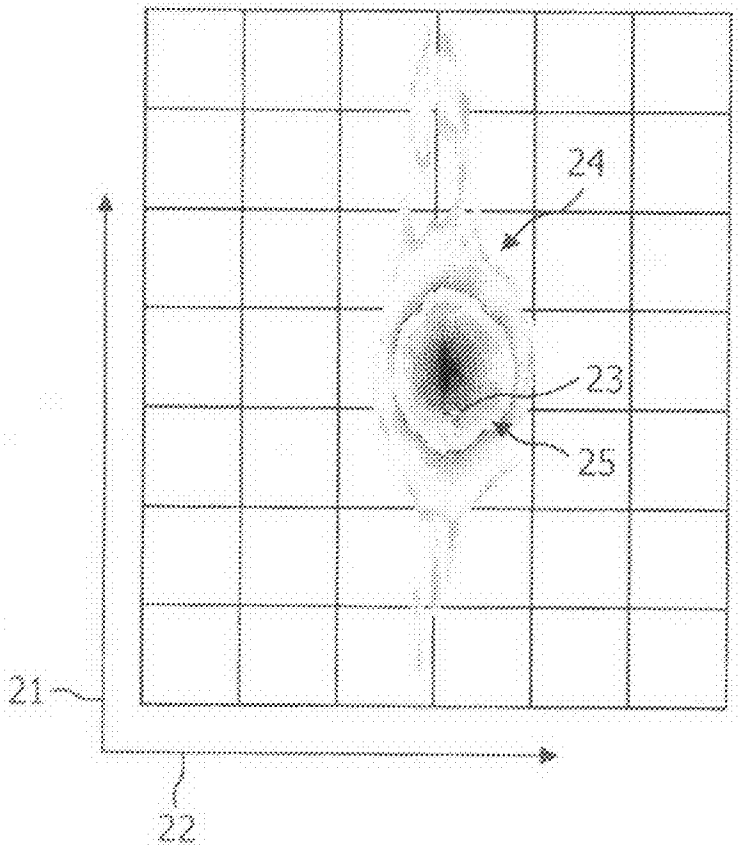
FIG. 3 shows a focal spot example for a structured directly heated flat emitter (DHFE) of the state of the art.

The result is illustrated in FIG. 3 for a directly heated flat emitter (DHFE) with 20 slits of 40 μm width in length direction of the emitter and, according to the invention, an unstructured indirectly heated flat emitter (IHFE) in FIG. 4. Both emitter types have an emission section of 3.7 mm×6.8 mm.

The gray scale presenting the concentration of emission reaches from 0% emission (white) to 100% emission (black) on an area with a width 21 and a length 22. The white cross 23 presents the optical axis of a focal spot 24. The arrow 25 presents 15% emission. The emitter with the slits has a focal spot size with a width of 0.59 mm and a length of 0.58 mm for U=75 kV and I=130 mA. The emitter with the unstructured emitting section has a focal spot size (FIG. 4) with a width of 0.54 mm and a length of 0.23 mm for U=75 kV and I=130 mA. The strongest influence is given for the length dimension with a size reduction of more than 50%. Hence, eliminating the slit structure significantly reduces the achievable spot size.

FIG. 5 shows a setup 29, comprising the indirectly heated emitter 26, according to the invention, a heating device 27 and a part of a cathode cup 28. FIG. 6 shows the assembly of FIG. 5 without the emitter and the cathode cup. The emitter 26 of the setup 29 comprises a non-structured well-defined electron emitting section 30 and fixing sections 31, 32, 33, 34 that keeps the plane surface in position and avoids deformations. By implementing the heating device 27 with an inhomogeneous temperature distribution, a cold center and an increasing temperature to the edges, in combination with a direct heating of the fixing sections of the emitter leads to an homogeneous temperature and hence electron emission distribution. The temperature difference within an area of 7×7 $mm^2$ can be reduce to $\Delta T$=30K for $T_{max}$=2240° C.

The shown setup 29 and operation mode may provides heating-up and cooling-down times of t<0.1 s while switching between $T_1$=2240° C. and $T_2$=2050° C. which corresponds to an emission reduction from 100% to 20%.

One way to realize an indirect heating of the emitter 26 with the non-structured emitting section 30 is given by the heating device 27 with the combination of an electron emitting part and the real filament that injects electrons into the electron optic. The electrons that are emitted from the heating device 27 are accelerated towards the filament of the emitter 26 by applying an electrical voltage between these parts with the heating device 27 on negative potential with respect to the optical emitter (filament). When the electrons impinge onto the filament's backside, their kinetic energy is transformed into heat and the filament temperature rises. Additionally, energy is transferred to the filament by radiation. This principle setup is shown in FIG. 5 and FIG. 16.

The heating device 27 is directly heated by electrical current and therefore needs a high electrical resistance which is e.g. realized by a meander structured foil. To avoid electrons emitting from the side wall of the foil into the optical system, a blocking frame 36 is implemented around and on the heating device's backside (FIG. 6). This frame 36 is on the same electrical potential than the heating device 27 itself. The emitting area 37 of the heating device 27 is slightly smaller than the filament's emission area 30 to reduce the amount of electrons that are ejected through the slit between filament and cathode cup 28 into the high voltage region. The dimensions are e.g. an emitter of 7 mm×7 mm in size and a heating device of 6.5 mm×6.5 mm in size. The foils thickness of both parts, heating device and emitter, is in the range of 100-200 μm making fast thermal responses achievable. The cathode cup 28 and the emitter 26 are on the same electrical potential.

Figure 7:
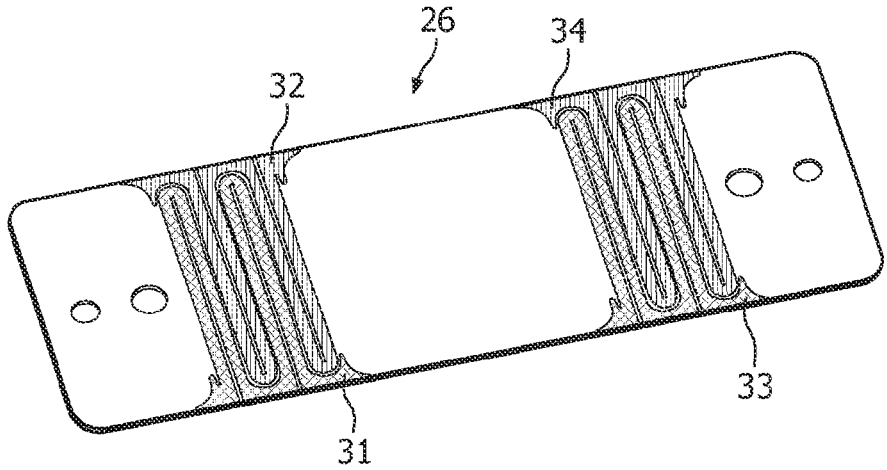
FIG. 7 shows an emitter with symmetrically arranged fixing sections.

FIG. 7 shows an emitter 26, as shown in FIG. 5 with symmetrically arranged fixing sections 31 to 34. One major problem of such a flat unstructured emitter 26 may be its thermal expansion. This expansion could lead to a deformation of the emitting section 30 which would drastically reduce the optical quality of the electron source. To compensate this expansion, a spring structure of the fixing sections 31 to 34 is realized at the ends of the emitting section 30 of the IHFE like exemplarily shown in FIG. 5 with a fixing at all corners of the emitting section 30 and a 'double meander' structure on both ends. This arrangement allows to apply a mechanical pretension in a way, that the elongation of the emitting section 30 during its hot phase is compensated. For a A=7 mm×7 mm emitting section of T=2200° C., this pretension is realized by elongation in the range of 80-120 μm. The spring must be designed following the boundary condition that this pretension causes no plastic deformation.

Furthermore, this structure forms a heat barrier between the terminals at both ends (heat sink) and the hot part which leads to the necessary well-defined emitting section 30.

FIG. 8 shows another emitter 40 according to the invention with four fixing sections 41 to 44 mounted on a mounting device 45 and a rectangular emitting section 46.

The principle emitter design as shown in FIG. 7 only compensates the elongation in one direction. The expansion in the perpendicular direction leads to additional mechanical stress within the spring structure that is not compensated. The resulting reset force may lead to a deformation of the thin foil.

A different design is presented in FIG. 8. This more complex structure, with four terminals as fixing sections 41 to 44 to fix the emitter 40, compensates the elongation in all plane directions. The surrounding slit 47 between the mounting device 45 and the emitter 40 is necessary to avoid electrical field deformation at the edges. The small slit 47 between surrounding and emitter has no significant influence on the optical properties due to its negligible small area in comparison to the entire emitting section 46.

The FIG. 9 to FIG. 12 and FIG. 14 show temperature distributions of the emitter surface shown in FIG. 8, heated by a heating device shown in FIG. 5 and FIG. 6. Particularly, FIG. 11 shows a temperature distribution of the emitter surface with a combination of indirect heating via electron bombardment and direct heating by applying an electrical current to the fixing sections at the corners of the emitting section. FIG. 12 shows another temperature distribution as shown in FIG. 11.

FIG. 13 shows a temperature and electron emitting distribution of a directly heated heating device. Finally, FIG. 14 shows a temperature distribution resulting from the heating device shown in FIG. 13.

Figure 9:
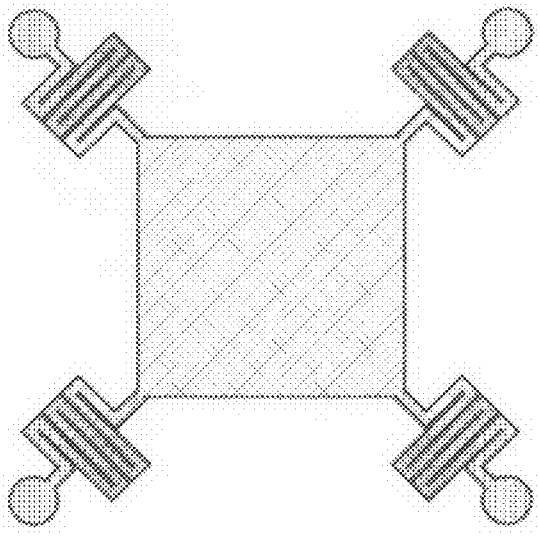

The temperature distribution of the 7 mm×7 mm emitter, when heated by a 6.5 mm×6.5 mm heater with a homogenous temperature, is generally shown in FIG. 9 and in more detail in FIG. 10. This setup causes a maximum temperature difference of $\Delta T$=150K between center and corner at T=2240° C. But only the thermo-mechanical expansion due to the average temperature of the area is compensated by external pretension. The temperature difference within the area causes high mechanical stress and therefore a bending of the foil.

Another idea of this invention is given by using a heating device 50 with a decreasing temperature from the edge to the center (FIG. 13). The heating device 50 comprises a flat structured heating section 51 and two fixing sections 52, 53. The heating section 51 is subdivided by a plurality of slits into a plurality of thermal regions. The temperature difference can then be reduce to $\Delta T$=95K (FIG. 14). The inhomogeneous temperature distribution of the heater can be realized e.g. by a double helix structure with an increasing width of the wires towards the center. This can be optimized but not completely eliminated as there is still the influence of the heat sink given by the terminals of the emitter.

Another improvement of this invention is as follows: The pretension spring structure by itself has a relative high electrical resistance compared to the emitting area. Hence, by applying an electrical current to the terminals, the springs are heated up and the temperature difference ΔT decreases. In principle this is shown in FIG. 11 and FIG. 12. The higher thermal gradient in the spring is not problematic because the gradient acts in the direction of the structure and is therefore compensated by the pretension. A disadvantage, but with an insignificant influence on the quality of the entire electron source, is given by the small hot sections of the springs that also emit electrons. Regarding the emitter area size in comparison to these sections, this effect is negligible. By this combination of an inhomogeneous indirect electron bombardment on and the direct electric current supply to the emitter, a temperature difference of only ΔT=30° C. is easily achievable. That can be further reduced by optimization of current, spring structure design and indirect heating characteristic.

Realizing thicker and larger structures, the above mentioned problems to guarantee a homogenous temperature distribution of the emitter and its mechanical stability, especially regarding the flatness, can drastically be reduced. But for medical applications, it is necessary to realize an emitter with a fast thermal response like it is provided by the thin and small indirectly/directly heated electron source design.

FIG. 15 shows the transient thermal dynamic of an emitter of 100 μm in thickness as described in FIG. 11 with a boosted heating-up section (I), the controlled steady-state mode (II) and the passive cooling-down section (III). The temperature difference of ΔT=155° C. from $T_1$=2230° C. to $T_2$=2075° C. corresponds to an emission reduction of 80% according to the following equation for the current density j:

$$j = AT^2 e^{\frac{-w_e}{k_B T}} \tag{2}$$

with Richardson constant A=120 A/cm$^2$/K$^2$, work function $W_e$=4.5 eV for tungsten and Boltzmann constant $k_B$=1.38e-23 J/K. As is illustrated in FIG. 15 with starting from an emitter temperature of T=600° C. (I), it is possible to increase the temperature up to a maximum of 100% within t=0.5 s by boosting the acceleration voltage between heater (heater emission current $I_{EH}$=500 mA) and emitter to $V_H$=270V (power P=135 W). Subsequently, a reduction down to $V_H$=80V (P=40 W) leads then to the steady-state mode (II). By controlling the boost phase and the transition into the steady-state, a much faster heating can be realized. For cooling down to reduce the tube current $I_E$ e.g. from 100% down to 20% the voltage $V_H$ has to be switched off only for t=0.1 s. An additional subsequent control could keep the tube current constant which is not realized in FIG. 15. The fast thermal response is sufficient for medical requirements.

FIG. 16 shows a schematic emitting control setup 50 with an indirectly heated emitter 51 according to the invention. The principle electrical circuit shown in FIG. 16 describes the electron source control. It is a tube power controlled setup with the tube current $I_E$, the high voltage HV, the current between a heating device 52 and the emitter 51 $I_{EH}$ and the acceleration voltage between heating device and emitter 51 $V_H$ as input values. The actuating variables are the heating current $I_H$ and $V_H$. Also shown is an anode 53.

The invention generally includes a setup of an electron source for X-ray-tubes comprising a non-structured indirectly-heated or directly/indirectly heated flat emitter section with fast response regarding to the emitting current. This setup leads to smaller focal spot sizes than achievable with common electron sources without losing the necessary fast response times for medical examinations. By implementing a heating device with an inhomogeneous temperature distribution, a cold center and an increasing temperature to the edges, in combination with a direct heating of the fixture part of the emitter leads to an homogeneous temperature and hence electron emitting distribution. One way to realize an indirect heating of a non-structured foil is given by a combination of an electron emitting part and the real filament that injects electrons into the electron optic.

It should be noted that the term "comprising" does not exclude other elements or steps and the "a" or "an" does not exclude a plurality. Further, it should be noted, that any reference signs in the claims shall not be construed as limiting the scope of the claims.

The invention claimed is:

1. An emitter for X-ray tubes comprising: a flat foil with an emitting section; and at least two electrically conductive fixing sections;

wherein the emitting section is unstructured and each fixing section is connected with a corner of the emitting section.

2. An emitter as claimed in claim 1;

wherein the foil has a uniformly thickness in a range between 50 μm and 300 μm.

3. An emitter as claimed in claim 1;

wherein the foil has a uniformly thickness in a range between 100 μm and 200 μm.

4. An emitter as claimed in claim 1;

wherein the foil consists of tungsten or a tungsten alloy.

5. An emitter as claimed in claim 1;

wherein the fixing sections have a spring structure.

6. An emitter for X-ray tubes comprising:

a flat foil with an emitting section;

and at least two electrically conductive fixing sections;

wherein the emitting section has a rectangular shape and is unstructured; and wherein the direction of the resilience of each fixing section is in-line with one diagonal of the shape of the emitting section to compensate the thermal expansion of the emitting section in all plane directions.

7. A heating device to heat an emitter for X-ray tubes comprising: a flat foil with an emitting section; and at least two electrically conductive fixing sections; wherein the emitting section is unstructured, said heating device comprising:

a flat structured heating section;

at least two fixing sections;

wherein the heating section is subdivided by a plurality of slits into a plurality of thermal regions.

8. A heating device as claimed in claim 7;

wherein the slits have a spiral shape.

9. A setup comprising an emitter as claimed in claim 1 and a heating device.

10. An X-ray tube with an emitter as claimed in claim 1.

11. A heating method to heat a setup comprising a heating device having a pair of fixing sections, and an emitter for X-ray tubes comprising: a flat foil with an emitting section; and at least two electrically conductive fixing sections; wherein the emitting section is unstructured, said method comprising:

applying an electrical current to said pair of fixing sections of the heating device to cause electron bombardment onto the emitting section of the emitter.

12. The heating method of claim 11, comprising:

applying an electrical current into the at least two fixing sections of the emitter.

* * * * *